US006408455B2

(12) United States Patent
Shimizu

(10) Patent No.: US 6,408,455 B2
(45) **Date of Patent: *Jun. 25, 2002**

(54) AUTOMATIC HAIR WASHER

(75) Inventor: Hirohisa Shimizu, Osaka (JP)

(73) Assignee: Oohiro Works, Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/377,931

(22) Filed: Aug. 20, 1999

(30) Foreign Application Priority Data

Nov. 10, 1998 (JP) ..... 10-319325

(51) Int. Cl.[7] ..... A45D 19/02
(52) U.S. Cl. ..... 4/518; 4/515; 4/516; 4/517
(58) Field of Search ..... 4/515, 516, 517, 4/518, 598, 601, 602, 603, 605, 597, 618

(56) References Cited

U.S. PATENT DOCUMENTS 3,686,924 A * 8/1972 Ludt et al.
4,289,954 A * 9/1981 Brognano et al. ..... 219/307
4,333,002 A * 6/1982 Kozak ..... 219/321
4,870,252 A * 9/1989 Balmer ..... 219/331
4,998,302 A * 3/1991 Silva ..... 4/516
5,442,157 A * 8/1995 Jackson ..... 219/492
5,906,012 A * 5/1999 Sakane et al. ..... 4/515

FOREIGN PATENT DOCUMENTS

JP 7-231807 9/1995

* cited by examiner

*Primary Examiner*—Gregory L. Huson
*Assistant Examiner*—Khoa Huynh
(74) *Attorney, Agent, or Firm*—Burr & Brown

(57) ABSTRACT

An automatic hair washer which performs hair washing by supplying wash water in a hot water storing tank to washing nozzles. The automatic hair washer includes a temperature gauge for measuring the temperature of the wash water. The temperature gauge is placed within the hot water storing tank. A heater for heating the wash water is placed within the hot water storing tank, and a heater control is also included for controlling the heater to operate and heat the wash water in the hot water storing tank to a predetermined temperature when the temperature of the wash water is below the predetermined temperature.

1 Claim, 3 Drawing Sheets

AUTOMATIC HAIR WASHER

FIELD OF THE INVENTION

The present invention relates to an automatic hair washer which is found in a beauty salon, a barber's shop or the like, and automatically washes a person's hair.

BACKGROUND OF THE INVENTION

FIG. 2 is a diagram illustrating a construction of a prior art automatic hair washer.

In the figure, reference numeral 1 designates a tank for mixing cold water and hot water, which are delivered from an external water supply and an external hot water supply via a curb stop, a strainer, and a check valve (which are not shown), to prepare wash water having a temperature suitable for hair washing. Numeral 2 designates a motor valve. Numeral 3 designates a hot water storing tank for storing the wash water supplied from the mixing tank 1 via the motor valve 2. Numeral 4 designates a thermistor provided at a lower position of the hot water storing tank 3 to measure the temperature of the wash water in the warm water storing tank 3. Numeral 5 designates a float switch having an upper limit water level sensor and a lower limit water level sensor. The upper limit water level sensor enables one to detect whether or not the wash water in the warm water storing tank 3 is full and the lower limit water level sensor enables one to detect whether or not there is very little wash water in the hot water storing tank 3. Numeral 6 designates a hot water supplying pump for pumping out the wash water from the hot water storing tank 3. Numeral 7 designates a valve for hand shower. Numeral 8 designates a drawable hand shower used for washing off hairs, shampoo agent or rinse agent which are attached to a cistern, or in finishing hair washing. Character $A_1$ designates a hot water supply pipe, one end of which is connected to the hot water supplying pump 6 to lead the wash water pumped by the hot water supplying pump 6. Numeral 9 designates a drainage electromagnetic valve provided in midway of the hot water supply pipe $A_1$ to drain unnecessary wash water. Numerals 10*a* to 10*k* designate hot water supplying electromagnetic valves. Characters $SV_1$ to $SV_{11}$ designate shower heads, each being connected to an end of the branched hot water supply pipe $A_1$ to spout the wash water. Numeral 11 designates a shampoo tank for storing shampoo agent. Numeral 12 designates a rinse tank for storing rinse agent. Numeral 13 designates a shampoo supplying pump for pumping out the shampoo agent from the shampoo tank 11. Numeral 14 designates a rinse supplying pump for pumping out the rinse agent from the rinse tank 12. Numerals 15 and 16 designate check valves. Numerals 17*a* to 17*f* designate nozzle heads, each being connected to an end of the branched hot water supply pipe $A_1$ to spout the wash water mixed with the shampoo agent or the rinse agent which is pumped out from the shampoo tank 11 or the rinse tank 12.

FIG. 3 is a longitudinal sectional view illustrating a cistern in the prior art automatic hair washer.

In the figure, the same reference numerals and characters as those in FIG. 2 designate the same or corresponding parts. Character B designates a cistern. A person whose hair is to be washed lies on his back and inserts his head into this cistern B to have his hair washed. As shown in the figure, a plurality of washing nozzles are provided inside the cistern B and the wash water is spouted from these washing nozzles and reaches to the head of the person under hair washing.

Hereinafter, operation of the prior art automatic hair washer will be described.

First, in an initial operation, hot water and cold water is to the mixing tank 1 from an external water supply and an external hot water supply via a curb stop, a strainer, and a check valve. The hot water and the cold water is mixed in the mixing tank 1 to be warm water having a temperature suitable for hair washing, and supplied to the hot water storing tank 3 via the motor valve 2. The wash water stored in the hot water storing tank 3 is delivered from the hot water supplying pump 6 and spouted from the shower heads $SV_1$ to $SV_{11}$ through the hot water supply pipe $A_1$ via the hot water supplying electromagnetic valves 10*a* to 10*k*. After the wash water is spouted from the shower heads $SV_1$ to $SV_{11}$ during a predetermined time, spouting of the wash water is stopped and the subsequent process, i.e., shampooing process is started. The shampoo agent pumped by the shampoo supplying pump 13 is spouted from the nozzle heads 17*a* to 17*f* together with the wash water. When the shampooing process ends, the subsequent rinsing process and the process for washing with clean water follow, and then the washing processes ends.

In using the above-described prior art automatic hair washer, any water remaining in the warm water storing tank at the end of hair washing is drained. This is because time may pass before the next hair washing and the wash water remaining in the hot water storing tank may be cooled, thereby making it impossible to use that wash water. Therefore, when a large amount of wash water remains in the hot water storing tank at the end of hair washing, the large amount of wash water is wasted in vain and this is quite uneconomical.

SUMMARY OF THE INVENTION

To solve the above problems, it is an object of the present invention to provide an automatic hair washer which does not drain wash water remaining in the hot water storing tank at the end of hair washing but instead, uses the wash water in the next hair washing.

Other objects and advantages of the present invention will become apparent from the detailed description below specific embodiments described are provided only for illustration purposes since various additions and modifications within the spirit and scope of the invention will be apparent to those of skill in the art from the detailed description.

According to a first aspect of the present invention, an automatic hair washer performing hair washing by supplying wash water in a hot water storing tank to washing nozzles comprises a temperature detecting means for measuring a temperature of the wash water in the hot water storing tank, a heater for heating the wash water in the hot water storing tank, and a heater control means for controlling the heater to operate and heat the wash water in the hot water storing tank to have a predetermined temperature when the wash water has a temperature below the predetermined temperature. Therefore, the wash water remaining in the hot water storing tank at the end of hair washing is not drained but, rather used in the next hair washing after being heated by the heater, thereby saving water.

According to a second aspect of the present invention, the automatic hair washer of the first aspect of the present invention comprises a water amount detecting means for detecting amount of the wash water in the hot water storing tank, and a heater control means for controlling the heater to operate and heat the wash water in the hot water storing tank to have a predetermined temperature when the wash water has a temperature below the predetermined temperature and the amount of the wash water in the hot water storing tank is more than a predetermined amount. Therefore, when the amount of wash water in the hot water storing tank is small, the wash water is not heated by the heater, thereby avoiding heating an empty tank and saving electricity.

DETAILED DESCRIPTION OF THE PREFERRED EMBODIMENTS

Embodiment 1

Figure 1:
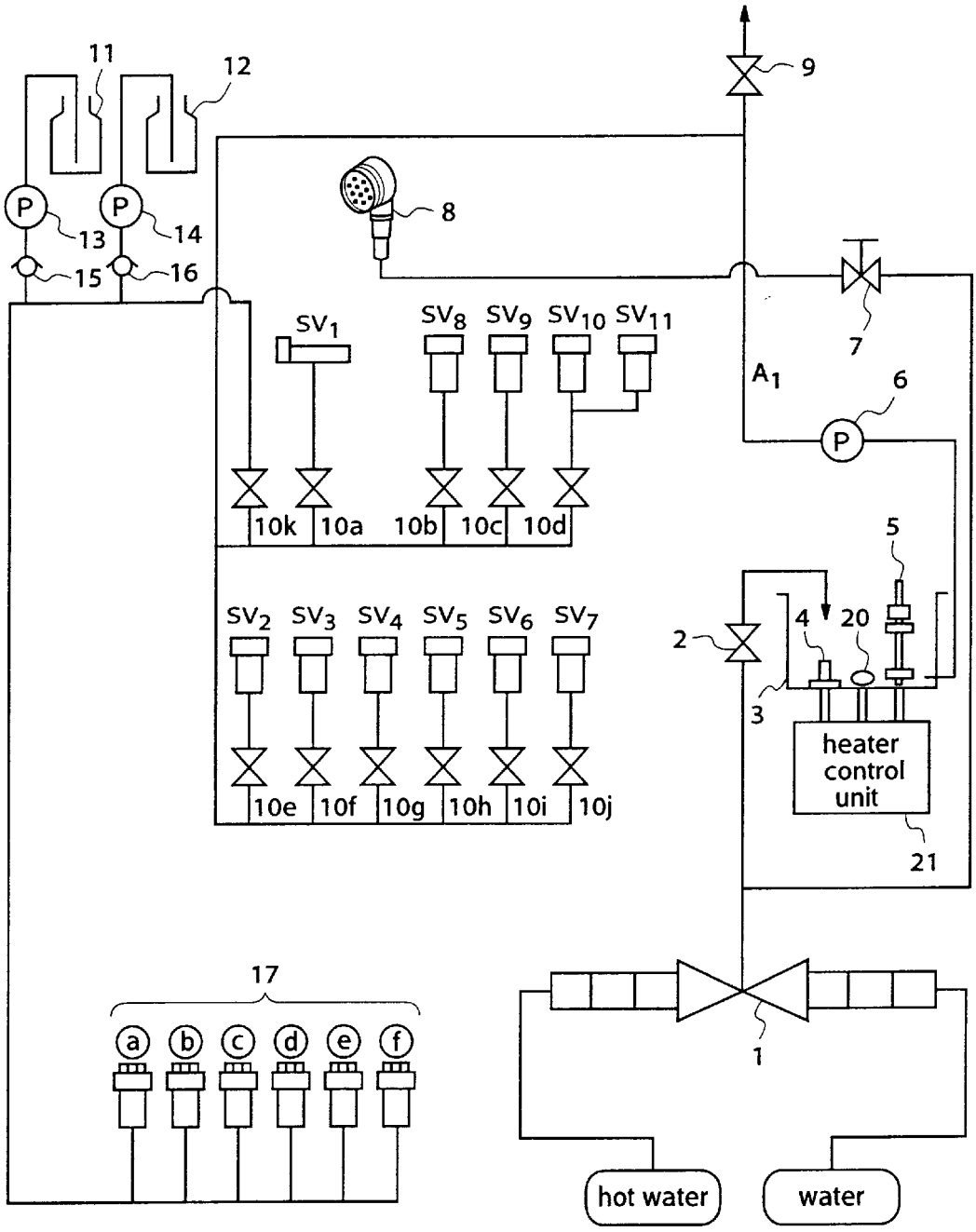
FIG. 1 is a diagram illustrating a construction of an automatic hair washer according to a first embodiment of the present invention.

FIG. 1 is a diagram illustrating a construction of an automatic hair washer according to a first embodiment of the present invention.

Figure 2:
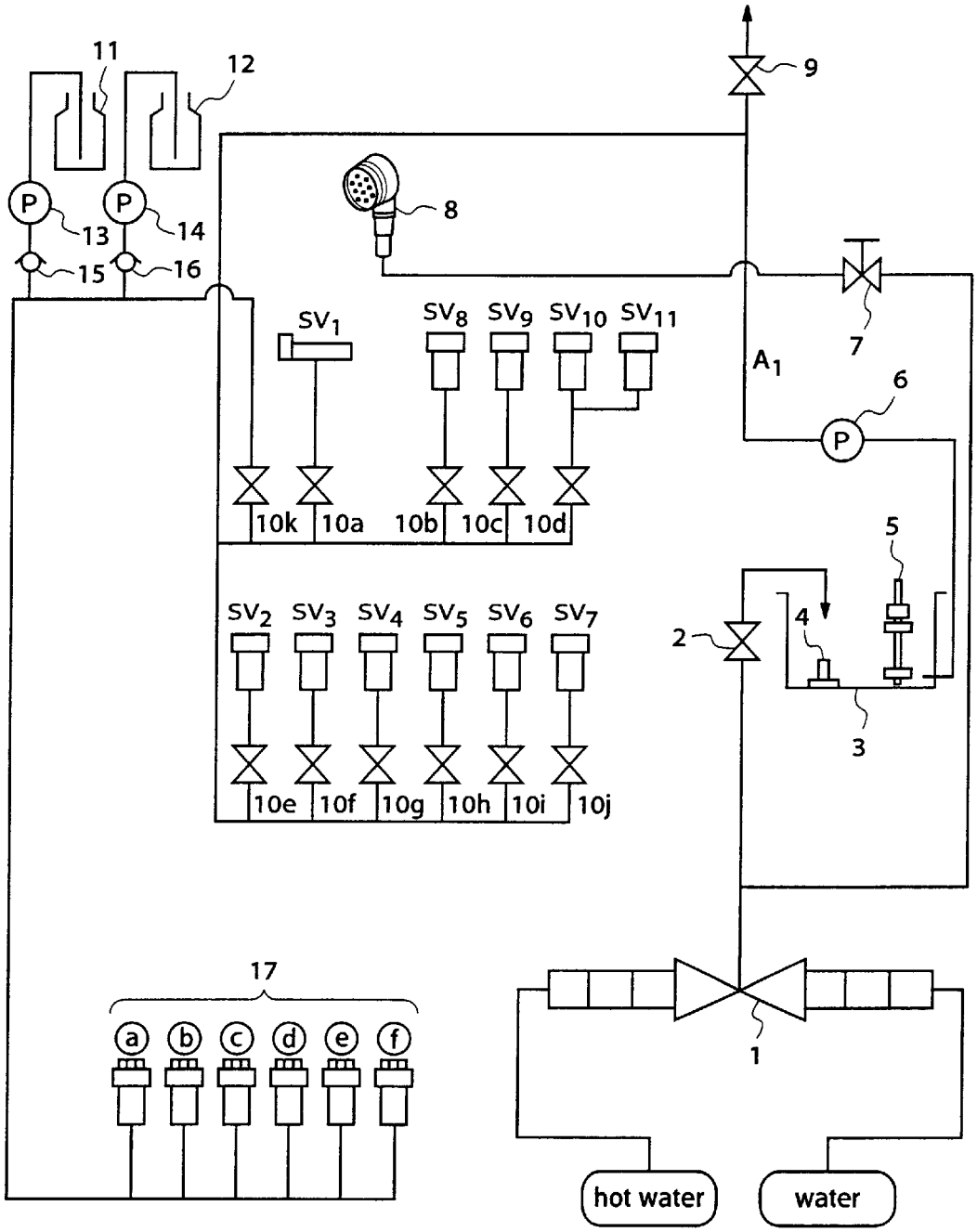
FIG. 2 is a longitudinal sectional view illustrating a cistern in the prior art automatic hair washer.
Figure 3:
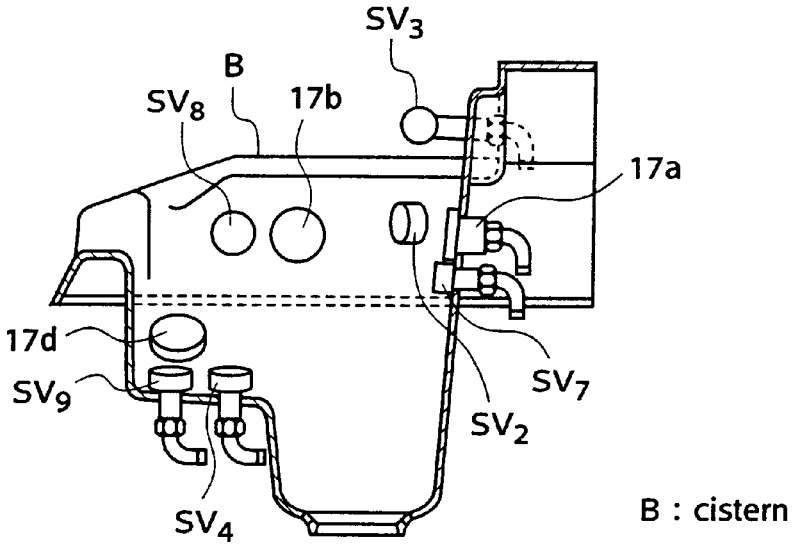
FIG. 3 is a diagram illustrating a construction of the prior art automatic hair washer.

In the figure, the same reference numerals and characters as those in FIG. 2 designate the same or corresponding parts. Reference numeral 20 designates a heater for heating wash water in the hot water storing tank 3. Numeral 21 designates a heater control unit for controlling the heater 20 in accordance with the temperature or water level of the wash water in the hot water storing tank 3.

Hereinafter, operation of the automatic hair washer according to the first embodiment will be described.

First, in an initial operation, hot water and cold water is given to the mixing 1 from an external water supply and an external hot water supply via a curb stop, a strainer, and a check valve. The hot water and the cold water is mixed in the mixing tank 1 to become warm water having a temperature suitable for hair washing and supplied to the hot water storing tank 3 until the hot water storing tank 3 becomes full.

The heater control unit 21 monitors the temperature and water level of the wash water in the hot water storing tank 3 by the thermistor 4 and the float switch 5 in process of hair washing. When the temperature of the wash water in the hot water storing tank 3 is below a set temperature and the water level thereof is over the lowest water level, the heater control unit 21 switches on the heater 20 to heat the wash water in the hot water storing tank 3 to have the set temperature.

On the other hand, when the wash water in the hot water storing tank 3 has a temperature below the set temperature and the water level is below the lowest water level, the heater control unit 21 does not start the heater 20 or, when the heater 20 is already working, switches off the heater 20. When the water level of the wash water in the hot water storing tank 3 is below the lowest water level, when hair washing is to be continued thereafter, warm water is supplied from the mixing 1 to replenish the hot water storing tank 3, and when hair washing is to be ended, the wash water remaining in the hot water storing tank 3 is drained from the drainage electromagnetic valve 9, whereby there is no need for insulation by the heater 20 in either case.

In the first embodiment, the heater 20 and the heater control unit 21 are provided in the hot water storing tank 3, and when the wash water in the hot water storing tank 3 has a temperature below the predetermined temperature, the heater 20 is started by the heater control unit 21, whereby the temperature of the wash water is set to the predetermined temperature. Therefore, even if the large amount of the wash water remains in the hot water storing tank 3 at the end of hair washing, the wash water is not drained but can be used in the following hair washing, thereby saving water. In addition, when the heater control unit 21 detects that the wash water in the hot water storing tank 3 has a temperature below the set temperature by the thermistor 4 and that the water level thereof is below the lowest water level by the float switch 5, heating of the wash water by the heater 20 is not performed, thereby avoiding heating an empty tank and saving electricity.

What is claimed is:

1. An automatic hair washer which performs hair washing by supplying wash water in a hot water storing tank to washing nozzles, which wash water is previously adjusted so as to be a predetermined temperature at an appropriate temperature for hair washing and then supplied to the hot water storing tank, said automatic hair washer comprising:

a temperature detecting means for measuring a temperature of the wash water, said temperature detecting means being positioned within said hot water storing tank, a water amount detecting means for detecting an amount of the wash water in the hot water storing tank, a heater for heating the wash water, said heater being positioned within said hot water storing tank, and a heater control means for controlling the heater, wherein said heater control means operates to heat the wash water in the hot water storing tank to a predetermined temperature when the temperature of the wash water is below the predetermined temperature and the amount of the wash water in the hot water storing tank is more than a minimum amount.

* * * * *